US006243117B1

(12) United States Patent
Brandon et al.

(10) Patent No.: US 6,243,117 B1
(45) Date of Patent: Jun. 5, 2001

(54) PRINT HEAD CARTRIDGE AND METHOD OF MAKING A PRINT HEAD CARTRIDGE BY ONE-SHOT INJECTION MOLDING

(75) Inventors: Fred Young Brandon, Lexington; Robert Arnold Christiansen, Salvisa, both of KY (US); Curtis Ray Droege, Belleville, IL (US); Lawrence Russell Steward; Gary Raymond Williams, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 08/439,912

(22) Filed: May 12, 1995

(51) Int. Cl.[7] ..... B41J 2/175
(52) U.S. Cl. ..... 347/87
(58) Field of Search ..... 347/86, 87; 156/60; 29/890.1

(56) References Cited

U.S. PATENT DOCUMENTS

| | | | | |
|---|---|---|---|---|
| 5,157,421 | * | 10/1992 | Kitahara | 347/86 |
| 5,280,300 | | 1/1994 | Fong et al. | 347/87 |
| 5,325,119 | | 6/1994 | Fong | 347/86 |
| 5,448,818 | * | 9/1995 | Scheffelin et al. | 347/86 |

FOREIGN PATENT DOCUMENTS

| | | |
|---|---|---|
| 0561051 | 9/1993 | (EP) . |
| 0583153 | 2/1994 | (EP) . |

OTHER PUBLICATIONS

Webster's Ninth New Collegiate Dictionary, 1990, p. 768.*

* cited by examiner

*Primary Examiner*—N. Le
(74) *Attorney, Agent, or Firm*—Griffin & Szipl, P.C.; B. Franklin Griffin, Jr.

(57) ABSTRACT

A print head having an ink reservoir therein is made by forming, in a one-shot plastic injection molding step, a rigid monolithic frame comprising high melt temperature material having an opening therein extending from a first side to a second side, and first and second bonding surfaces surrounding the opening and facing the first and second sides, respectively. First and second thin flexible films are adhesively secured to the first and second bonding surfaces, respectively. The adhesive material may be a hot melt adhesive or dry adhesive films pre-formed to the shape of the bonding surfaces. By securing the flexible films to the bonding surfaces adhesively, rather than by heat staking, it is not necessary to form the frame of different materials during two separate molding steps.

15 Claims, 4 Drawing Sheets

PRINT HEAD CARTRIDGE AND METHOD OF MAKING A PRINT HEAD CARTRIDGE BY ONE-SHOT INJECTION MOLDING

BACKGROUND OF THE INVENTION

1. Field of the Invention

The present invention relates to cartridges for ink jet print heads of the type wherein the ink reservoir is bounded by two thin films and a rigid frame. The invention provides novel cartridges made by a process wherein the frame is formed in a one-shot plastic injection molding step and the thin films are attached to the frame by adhesive bonding.

2. Prior Art

High capacity color ink jet printers configured around independent single color pens are currently commercially available. Typical pens or cartridges of the type suitable for use in such printers are shown in U.S. Pat. Nos. 5,280,300 and 5,325,119 and EP published applications 0 561 051 and 0 583 153.

As shown in FIG. 5 a typical prior art print head cartridge includes a frame 10 having a flexible ink-impervious thin membrane 12 and a side cover 14 disposed on one side. A second membrane and a second side cover (not shown) are disposed on the opposite side of frame 10. The frame 10 is formed by a two-shot plastic injection molding process. A rigid outer frame 16 (FIG. 6) of high melt temperature plastic is formed in a first mold during a first injection molding step. The rigid outer frame 16 is then placed in a second mold and a low melt temperature rubber-like plastic is injected into the mold. The rubber-like plastic forms an inner frame 18 molded onto outer frame 16, the inner and outer frames forming the frame 10 as shown in FIG. 7.

As shown in FIGS. 7 and 8, the inner frame 18 has oppositely facing flat side surfaces 20, 20' which extend around the entire periphery of the inner frame 18. The ink-impervious thin membranes 12 and 12' (FIG. 8) are heat staked to the surfaces 20 and 20' thereby forming a chamber or ink reservoir 22 bounded on opposite sides by the thin membranes and bounded around its periphery by the inner surface 24 of the inner frame 18.

The outer frame 16 is molded to have a downwardly extending nose portion 16A (FIG. 6) having therein a standpipe 26 as shown in FIG. 6. The standpipe 26 has an ink flow channel 28 which extends through the standpipe and outer frame 16 to the bottom surface 30 of the nose. The inner frame 18 is molded around the standpipe 26 so that the opening into channel 28 is not closed as the inner frame 18 is molded onto outer frame 16. This permits ink to flow from reservoir 22 through the channel 28 to the bottom surface of the nose from whence it may be ejected through a nozzle plate (not shown).

The prior art print head cartridges shown in FIGS. 5–8 has a disadvantage in that the frame requires two separate and distinct molding steps thus making the frame 10 almost twice as expensive to manufacture as a similar frame formed in a single molding step. The device cannot be formed in a single molding step because different materials are required for the inner frame 18 and outer frame 16. The requirement that the impervious films 12, 12' be heat staked to the inner frame 16 dictates that the material used in forming the inner frame be a low melt temperature, rubber-like material. That is, the material comprising the inner frame must have a melt temperature less than that of the membrane material to prevent tear or damage to the membrane during the staking process and so that it melts to form a bond with the membranes 12,12' during the heat staking of the membranes. Since the inner frame material is somewhat flexible, the rigid outer frame must be made of a stiff material in order to support the flexible ink reservoir.

As discussed in EP published application 0 561 051, print head cartridges made by the two-shot molding process have a further disadvantage in that the ink reservoir may leak where the inner frame 18 is molded around the standpipe 24.

SUMMARY OF THE INVENTION

An object of the present invention is to provide a method of making a print head cartridge, the method requiring only one plastic injection molding step.

A further object of the invention is to provide a method of making a print head cartridge having an ink reservoir therein bounded by first and second flexible films and a frame member, the films being secured to the frame by an adhesive bonding material.

According to the invention, a print head cartridge having an ink reservoir therein is made by (1) forming, in a single plastic injection molding step, a rigid monolithic frame having an interior surface facing an opening which extends through the frame from a first side to a second side, the interior surface comprising a peripheral wall of the ink reservoir when the opening is closed, the exterior surface of the frame comprising the peripheral exterior surface of the print head and the frame having first and second bonding surfaces spaced from each other and surround the opening, the bonding surfaces facing the first and second sides, respectively; (2) applying an adhesive bonding material to the first and second surfaces; and (3) securing first and second flexible films to the first and second bonding surfaces to thereby close the opening.

The adhesive material may be a hot melt adhesive such as ethylene vinyl acetate or a dry film adhesive pre-formed to the shapes of the bonding surfaces. When using one of these adhesives the flexible films are secured to the bonding surfaces by heat sealing or staking without melting the material of the frame.

The flexible films may each comprise a laminated polymeric film and may include a surface ply of a higher melt temperature polymer such as polyethylene terephthalate to prevent sticking of the low melt temperature polymer to the heat sealing tool.

In a further embodiment, the flexible films may be polyethylene terephthalate and the adhesive bonding material may cartridge be a liquid epoxy.

Another object of the invention is to provide a print head cartridge made by a process as described above.

Other objects and advantages of the invention will become evident upon consideration of the following description and the accompanying drawings.

DESCRIPTION OF PREFERRED EMBODIMENTS

FIGS. 1–4 illustrate a print head cartridge constructed according to the present invention. The cartridge includes a rigid frame 50, two flexible ink-impervious thin films 52,52' (FIG. 3) and two side covers 54, only one of the covers being shown in FIG. 1. The term 'thin film' as used herein means a thin, flexible sheet of material which may or may not be transparent.

Figure 1:
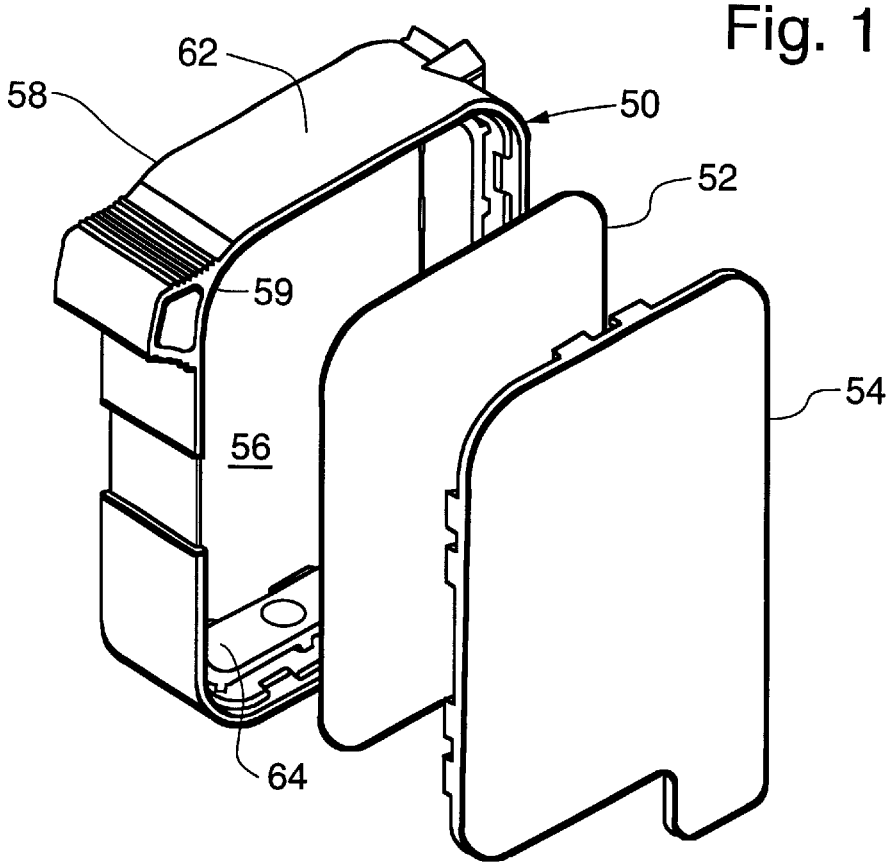
FIG. 1 is an exploded perspective view of a print head cartridge showing one side cover, one thin film and a one-piece frame according to the present invention.
Figure 2:
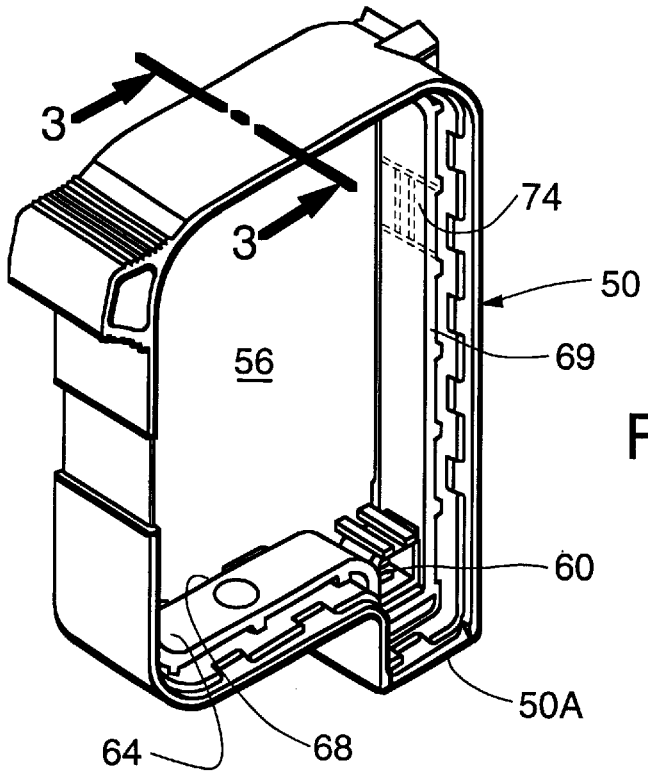
FIG. 2, is a perspective view of the one-piece frame of FIG. 1.

The rigid frame 50 is a monolithic structure formed by plastic injection molding in a single molding step so as to have the configuration shown in FIG. 2. The term 'monolithic structure' as used herein means a structure that is massively solid and uniform. That is, it consists of a single mass or piece and is substantially uniform in content, like an object obtained by injection molding. Rigid frame 50 is molded with a large opening 56 extending through it from a first side 58 to a second side 59. The exterior surface 62 of the rigid frame 50 comprises the peripheral outer surface of the cartridge. The interior surface 64 of frame 50 comprises the peripheral wall of an ink reservoir 66 (FIG. 3) when the opening 56 is closed on both sides by thin films 52, 52' as subsequently described.

The frame 50 is molded so as to have a nose portion 50A and a standpipe (not visible), the standpipe having an ink flow channel extending from an inlet opening 60 on the interior of the frame to an opening (not visible) in the lower surface of the nose portion. The frame 50 is also molded so as to have two continuous support shelves or bonding surfaces 68,69 spaced from each other and surrounding the opening 56. The bonding surfaces 68,69 face in opposite directions with surface 68 facing toward the first side 58 of the frame and surface 69 facing toward the second side 59.

After frame 50 is molded, an adhesive bonding material 70 (FIGS. 3 and 4) is applied to the bonding surfaces 68,69. The flexible films 52,52' are brought into position and adhesively secured to surfaces 68,69 by means of the adhesive bonding material 70.

In a preferred embodiment of the invention the thin flexible films 52,52' comprise a laminated low melt temperature polymeric material such as polyethylene and the adhesive bonding material is a hot melt adhesive. An ethylene vinyl acetate based hot melt similar to 3M Jet Melt 3764 is preferred. The thin flexible films 52,52' are secured to the bonding surfaces 68,69 by dispensing the hot melt adhesive onto the surfaces, bringing the thin films into contact with the adhesive, and heat sealing or staking the films. The heat sealing or staking is similar to the heat staking of the prior art described above except that the sealing temperature is such that the material of the frame 50 is not melted during the staking. In this regard the frame 50 comprises a high melt temperature material such as polyethylene terephthalate but obviously other plastic materials, with or without additives such as glass, may be used.

Figure 4:
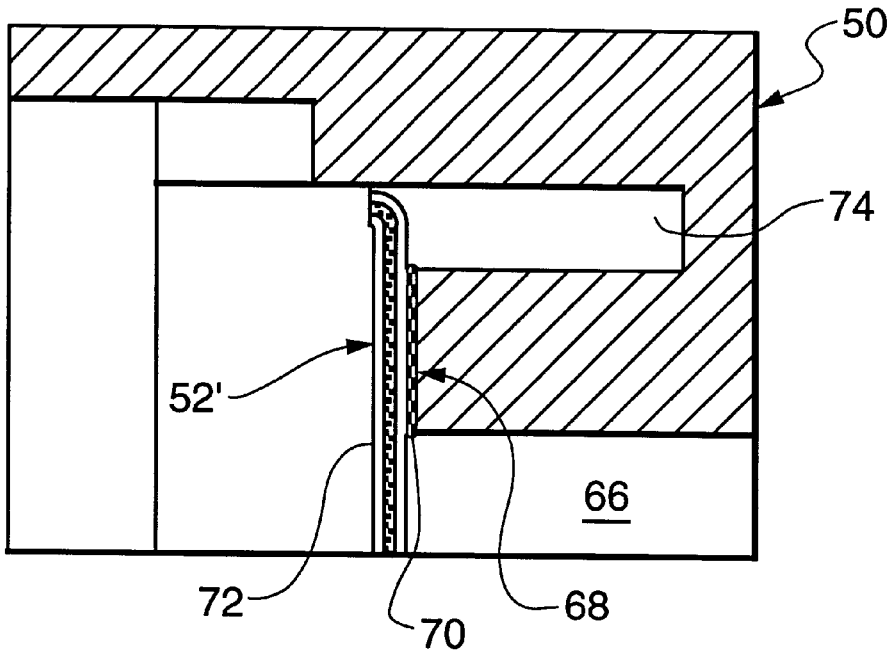
FIG. 4 is a part sectional view, on an enlarged scale, illustrating the layer structure of a laminated thin film.
Figure 5:
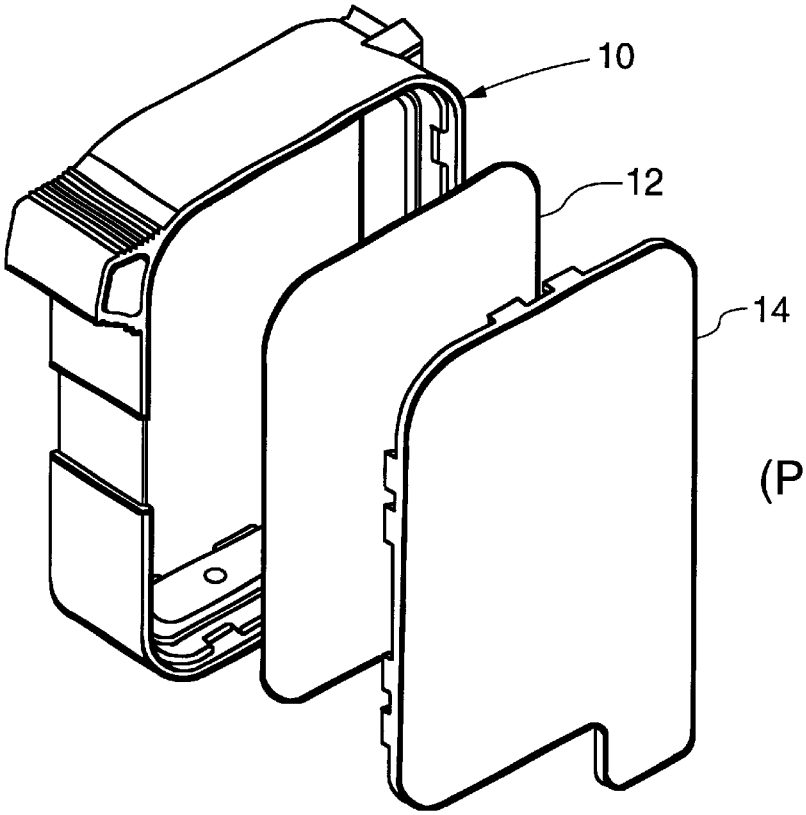
Fig. 5 (PRIOR ART)
FIG. 5 is an exploded perspective view of a print head cartridge showing one side cover, one thin film and a two-piece frame according to the prior art.
Figure 6:
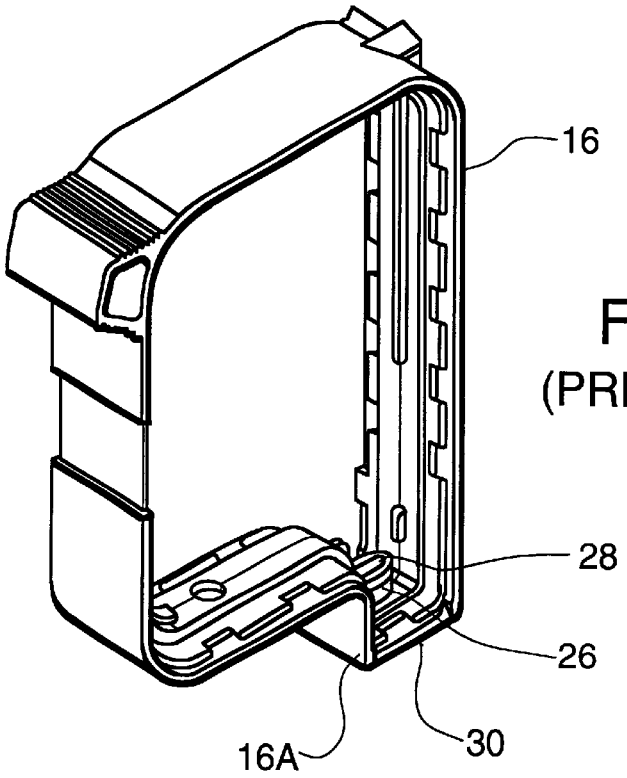
Fig. 6 (PRIOR ART)
FIG. 6 is a perspective view of a prior art frame after a first molding step.
Figure 7:
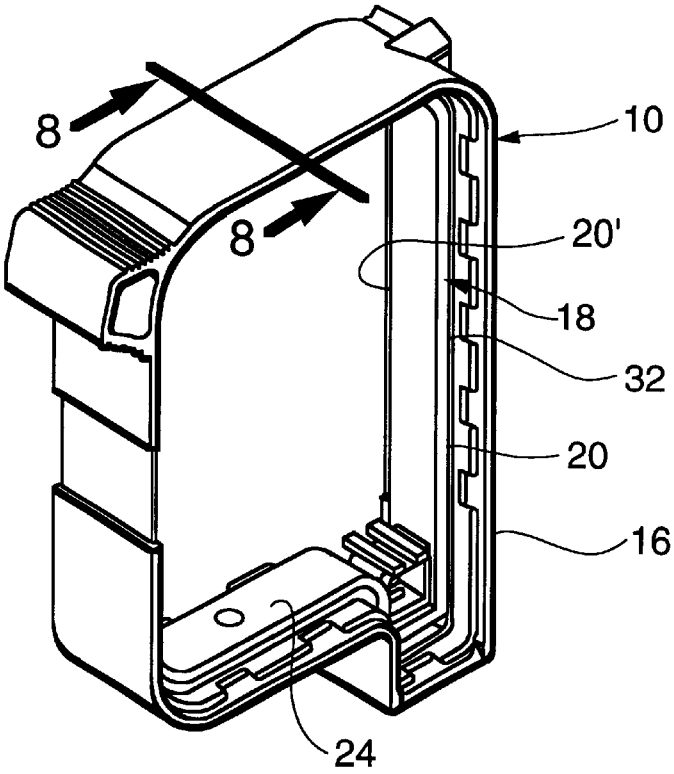
Fig. 7 (PRIOR ART)
FIG. 7 is a perspective view of a prior art frame after a second molding step; and, FIG. 8 is a sectional view taken along the line 8—8 of FIG. 7.
Figure 8:
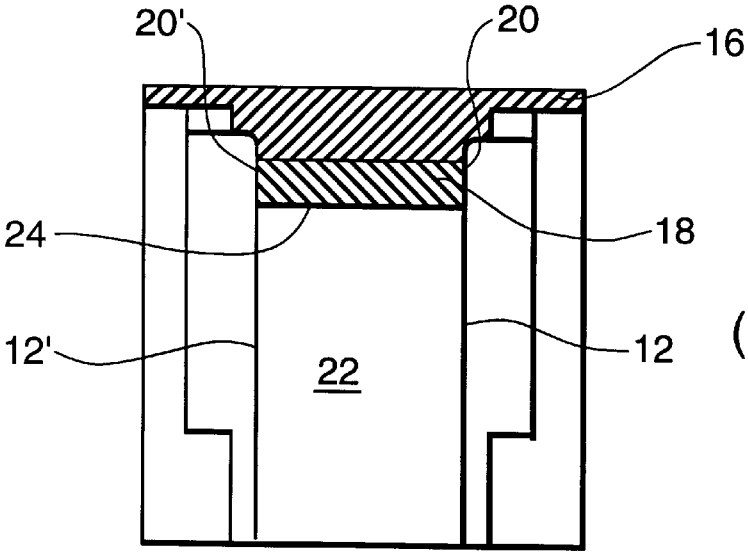
Fig. 8 (PRIOR ART)

As shown in FIG. 4, the laminated flexible films may comprise a plurality of layers with a surface layer 72 comprising a higher melt temperature polymer such as polyethylene terephthalate or polyamid. As a laminated flexible film 52 or 52' is placed in position for staking, the film is oriented so that the surface layer 72 faces the staking tool. Since the surface layer 72 has a higher melt temperature than the other layers, it does not melt and adhere to the heat sealing tool as the thin flexible films are bonded to the frame.

The adhesive bonding material may also take the form of a dry film adhesive pre-formed in shape to match the shape of the bonding surfaces 68,69. By way of example, a suitable dry film adhesive for this purpose is 3M 556 ethylene vinyl acetate (EVA). When a dry film adhesive is used as the adhesive bonding material, the thin flexible films 52,52' are secured to bonding surfaces 68,69 by placing the dry film adhesive preforms against the bonding surfaces, placing the flexible films adjacent the preforms, and then applying pressure to press the films toward the frame while applying moderate heat. A double sided pressure sensitive tape such as 3M 4932 acrylic tape could also be used for this purpose.

In an alternative embodiment of the invention, the thin flexible films 52', 52' may be polyethylene terephthalate (Mylar) in which case a liquid epoxy may be used to secure the flexible films to the bonding surfaces 68,69. However, liquid epoxy adhesives require post-curing which is a disadvantage in a high volume manufacturing operation.

From the foregoing description it is seen that the present invention provides a method of making a print head cartridge which reduces the manufacturing cost by about 50% as compared to a print head produced by the prior art method described with respect to FIGS. 5–8, the reduction in cost being attained by eliminating one of two molding steps. Since the frame, including the standpipe, is molded in one piece, the interface between two molded parts, and the attendant problem of ink leakage at the interface are eliminated.

Figure 3:
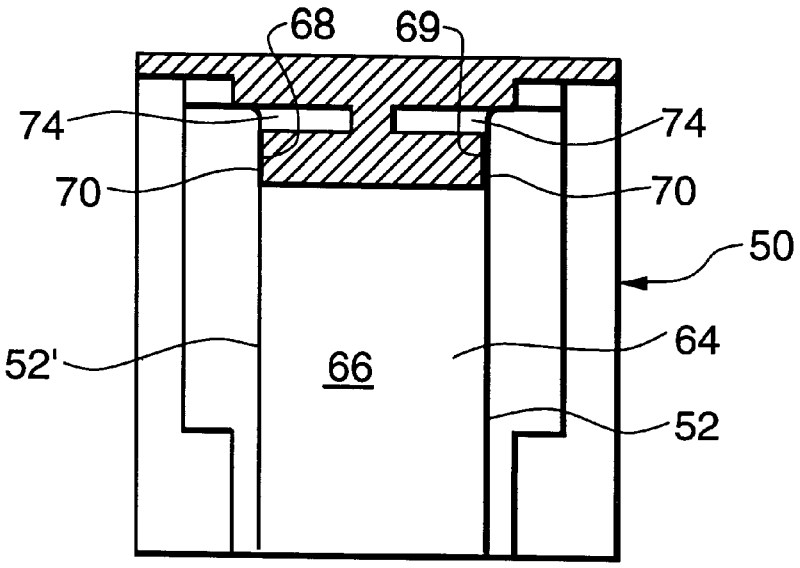
FIG. 3 is a sectional view taken along the line 3—3 of FIG. 2.

The method of the present invention permits the making of cartridges in the same configuration as cartridges made by the method described with respect to FIGS. 5–8. In this regard, it will be noted from FIG. 8 that the combined thickness of the inner and outer frames 16,18 of the prior art device is considerable. To obtain the required thickness in a frame molded in a single molding step, the portion of the frame 50 corresponding to the support shelf 32 (FIG. 7) is cored according to general plastic design rules regarding wall thickness and the coring of thick sections so that the frame 50 exhibits a plurality of cavities 74 as shown in FIG. 3.

Although the invention has been described in specific detail with respect to preferred embodiments, it will be understood that various modifications and substitutions may be made in the described embodiments without departing from the spirit and scope of the invention as defined by the appended claims.

We claim:

1. A method of making a cartridge for an ink jet-printer, said cartridge having an ink reservoir therein, said method comprising:

forming, by a single plastic injection molding step, a rigid monolithic frame having an interior surface facing an opening extending through the frame from a first side to a second side, said interior surface comprising a peripheral wall of the ink reservoir when said opening is closed, an exterior surface which comprises a peripheral exterior surface of the cartridge, and, first and second bonding surfaces spaced from each other and surrounding said opening, said first and second bonding surfaces facing said first and second sides, respectively;

applying an adhesive bonding material to said first and second bonding surfaces; and, securing first and second flexible films to said first and second bonding surfaces, respectively, with said adhesive bonding material to thereby close said opening.

2. A method as claimed in claim 1 wherein said first and second flexible films each comprise a laminated low melt temperature polymeric film.

3. A method as claimed in claim 2 wherein said laminated polymeric films further comprise a surface ply of a higher melt temperature polymer.

4. A method as claimed in claim 3 wherein said higher melt temperature polymer is selected from the group comprising polyethylene terephthalate and polyamide.

5. A method as claimed in claim 1 wherein said adhesive bonding material is an ethylene vinyl acetate based hot melt adhesive.

6. A method as claimed in claim 1 wherein the step of securing the first and second flexible films to said first and second bonding surfaces is accomplished by heat sealing.

7. A method as claimed in claim 1 wherein said first and second flexible films are laminated polymeric films, said adhesive bonding material is an ethylene vinyl acetate hot melt, and the step of securing said first and second flexible films to said first and second bonding surfaces is accomplished by heat staking.

8. A method as claimed in claim 1 wherein the step of applying an adhesive bonding material comprises applying dry adhesive films in a pre-formed shape to said first and second bonding surfaces.

9. A method as claimed in claim 8 wherein the step of securing said first and second films to said first and second bonding surfaces is accomplished by placing the dry adhesive films adjacent said first and second bonding surfaces, placing the first and second flexible films adjacent said dry adhesive films, and applying pressure to press said first and second flexible films toward said first and second bonding surfaces.

10. A method as claimed in claim 9 wherein said adhesive bonding material comprises an acrylic material.

11. A method as claimed in claim 10 wherein heat is applied to said first and second flexible films while said pressure is being applied.

12. A method as claimed in claim 1 wherein said adhesive bonding material is a liquid epoxy.

13. A method as claimed in claim 1 wherein said adhesive bonding material is a liquid epoxy and said first and second flexible films are polyethylene terephthalate.

14. A method as claimed in claim 1 wherein said first and second flexible films comprise low melt temperature laminated polymeric films and the step of securing said first and second flexible films to said first and second bonding surfaces is accomplished by heat staking, said first and second flexible films having a surface ply of a higher melt temperature material to preclude sticking of the low melt temperature polymeric films to a tool during heat staking.

15. A method as claimed in claim 1 wherein said rigid monolithic frame is cored during forming so as to form a support shelf spaced by cavities from a portion of said frame having said exterior surface, whereby said first and second bonding surfaces are bounded at a first side by said interior surface and bounded at a second side by said cavities.

* * * * *